US006264381B1

(12) United States Patent
Ueda

(10) Patent No.: US 6,264,381 B1
(45) Date of Patent: Jul. 24, 2001

(54) PROCESS SYSTEM

(75) Inventor: Issei Ueda, Kumamoto (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/532,453

(22) Filed: Mar. 23, 2000

(30) Foreign Application Priority Data

Mar. 24, 1999 (JP) ..... 11-079057

(51) Int. Cl.[7] ..... G03D 5/00
(52) U.S. Cl. ..... 396/604; 396/611
(58) Field of Search ..... 396/611, 604; 118/52, 319, 320, 668, 500; 414/416, 935, 937, 940

(56) References Cited

U.S. PATENT DOCUMENTS 5,803,932 9/1998 Akimoto et al. ..... 29/25.01
6,161,969 * 12/2000 Kimura et al. ..... 396/611

FOREIGN PATENT DOCUMENTS 10-144763 5/1998 (JP) .

* cited by examiner

*Primary Examiner*—D. Rutledge
(74) *Attorney, Agent, or Firm*—Rader, Fishman & Grauer

(57) ABSTRACT

A process unit block is disposed at a rear portion on one side of a process station. The process unit block has multi-staged heating and cooling process units. A transferring table is disposed at a center portion of the other side of the process station. Process units are disposed at an upper front portion of the process station. A vertical type conveying unit is disposed at a nearly center portion of the process station. Since a plurality of process stations that have the same structure are connected, the system can be dynamically and effectively expanded or reduced.

21 Claims, 11 Drawing Sheets

PROCESS SYSTEM

BACKGROUND OF THE INVENTION

1. Field of the Invention

The present invention relates to a process system for forming a resist film on a semiconductor wafer and developing an exposed resist film.

2. Description of the Related Art

In a photo-resist step of a semiconductor fabrication process, a resist is coated on the front surface of for example a semiconductor wafer (hereinafter referred to as wafer). As a result, a resist film is formed. After a pattern is exposed on a wafer, with a developing solution, a developing process is performed. To perform such a process, a coating and developing process system is used.

In the coating and developing process system, various units are used. For example, a unit that coats a resist on a wafer, a unit that supplies a developing solution to the wafer that has been exposed, a unit that cools the wafer, and a unit that heats the wafer are used. In addition, a conveying unit that transfers a wafer among these units is disposed.

To compactly structure the coating and developing process system, a vertical conveying unit that conveys a wafer in the vertical direction and the direction is disposed at a center portion of the system. A plurality of multi-staged unit blocks are disposed around the conveying unit.

However, such a coating and developing process system cannot be dynamically expanded or reduced. In other words, to expand such a system, the number of stages of units or the number of unit blocks can be increased. However, it is impossible to dynamically expand the system for example two times or three times. Thus, conventionally, to dynamically expand the system, for example, the number of coating and developing process systems are increased.

When the number of units of the system is increased, the following problem will take place. In other words, in the coating and developing process system, a substrate loading/unloading portion is disposed between process stations each of which is composed of a unit block and a conveying unit. The substrate loading/unloading portion is composed of for example an interface portion that transfers a wafer between a cassette station and an exposing unit. The cassette station loads and unloads a cassette accommodating many wafers with an AGV (Automatic Guided Vehicle). Thus, when the number of units of the system is increased, the number of substrate loading/unloading portions is increased. However, since the process performance of the entire system depends on the process performance of each process station, the expanded substrate loading/unloading portions become redundant.

In addition, in such a coating and developing process system, unit blocks are disposed around a conveying unit. Thus, it is difficult to perform a maintenance work for the conveying unit.

SUMMARY OF THE INVENTION

An object of the present invention is to provide a process system that can dynamically and effectively expand or reduce the system.

Another object of the present invention is to provide a process system of which a maintenance work for a conveying portion can be easily performed.

A first aspect of the present invention is a process system, comprising a plurality of process stations whose side surfaces are successively connected, and two substrate loading/unloading portions, disposed adjacent to the outer side surfaces of two process stations at both ends of said plurality of process stations, for loading and unloading a substrate to/from each of said plurality of process stations, wherein each of said plurality of process stations has a first process unit block, disposed on one side of each of said plurality of process stations, having multi-staged first process units including a process unit for performing at least a heating process for a substrate, a substrate transferring table, disposed on the other side of each of said plurality of process stations, for transferring a substrate with at least adjacent one of said plurality of process stations, a second process unit, disposed on the front or the rear of each of said plurality of process stations, for supplying at least a predetermined solution to a substrate, and a conveying unit, disposed at a nearly center portion of each of said plurality of process stations, for conveying a substrate among the first process unit block, the second process unit, the local process station, and the substrate transferring table of the adjacent process station.

According to the present invention, since a plurality of process stations having the same structure are disposed between substrate loading/unloading portions, the system can be dynamically and effectively performed. When the process performance is improved for example two times or three times, the number of process stations disposed between the substrate loading/unloading portions is increased two time or three times. In contrast, it is not necessary to increase the number of substrate loading/unloading portions. In addition, according to the present invention, since the conveying unit can be easily accessed, the maintenance work for the conveying portion can be easily performed.

A second aspect of the present invention is a process system, comprising a plurality of process stations whose side surfaces are successively connected, and two substrate loading/unloading portions, disposed adjacent to the outer side surfaces of two process stations at both ends of said plurality of process stations, for loading and unloading a substrate to/from each of said plurality of process stations, wherein each of said plurality of process stations has a first process unit block, disposed on one side of each of said plurality of process stations, having multi-staged first process units including a process unit for performing at least a heating process for a substrate, a substrate transferring table, disposed on the other side of each of said plurality of process stations, for transferring a substrate with at least adjacent one of said plurality of process stations, a second process unit, disposed on the front or the rear of each of said plurality of process stations, the second process unit having a cooling process portion for performing a cooling process for a substrate, a process unit for supplying at least a predetermined solution to a substrate, and an inner-unit conveying unit for conveying a substrate between the process unit and the cooling process portion, and a conveying unit, disposed at a nearly center portion of each of said plurality of process stations, for conveying a substrate among the first process unit block, the cooling process portion of the second process unit, the substrate transferring table of the local process station, and the substrate transferring table of the adjacent process station.

According to the present invention, since a plurality of process stations having the same structure are disposed between substrate loading/unloading portions, the system can be dynamically and effectively performed. In addition, according to the present invention, since the conveying unit can be easily accessed, the maintenance work for the conveying portion can be easily performed. Moreover, according to the present invention, in particular, the second process unit block has the cooling process portion that cools a substrate and a process unit that supplies at least a predetermined solution to a substrate (namely, the cooling process portion and the process unit are disposed in the same unit block), the cooling process portion and the process unit can be operated in the same environment. Thus, the process unit can stably perform a predetermined process.

A third aspect of the present invention is a process system, comprising a plurality of process stations whose side surfaces are successively connected, and two substrate loading/unloading portions, disposed adjacent to the outer side surfaces of two process stations at both ends of said plurality of process stations, for loading and unloading a substrate to/from each of said plurality of process stations, wherein each of said plurality of process stations has a first process unit block, disposed on one side of each of said plurality of process stations, having multi-staged first process units including a process unit for performing at least a heating process for a substrate, a substrate transferring table, disposed on the other side of each of said plurality of process stations, for transferring a substrate with at least adjacent one of said plurality of process stations, a second process unit block, disposed on the front or the rear of each of said plurality of process stations, the second process unit block having multi-staged second process units including a process unit for supplying at least a predetermined solution to a wafer, a solution supplying portion, disposed outside the second process unit block, for supplying the predetermined solution to process units of the second process unit group, and a conveying unit, disposed at a nearly center portion of each of said plurality of process stations, for conveying a wafer among the first process unit block, the second process unit block, the local process station, and the substrate transferring table of the adjacent process station.

According to the present invention, since a plurality of process stations having the same structure are disposed between substrate loading/unloading portions, the system can be dynamically and effectively performed. In addition, according to the present invention, since the conveying unit can be easily accessed, the maintenance work for the conveying portion can be easily performed. Moreover, according to the present invention, since the solution supplying portion that supplies a predetermined solution to the process unit of the second process unit block is disposed outside thereof, the volume of the solution supplying portion can be increased. Thus, the amount of the solution stored in the solution supplying portion can be increased.

These and other objects, features and advantages of the present invention will become more apparent in light of the following detailed description of a best mode embodiment thereof, as illustrated in the accompanying drawings.

DESCRIPTION OF PREFERRED EMBODIMENTS

Figure 1:
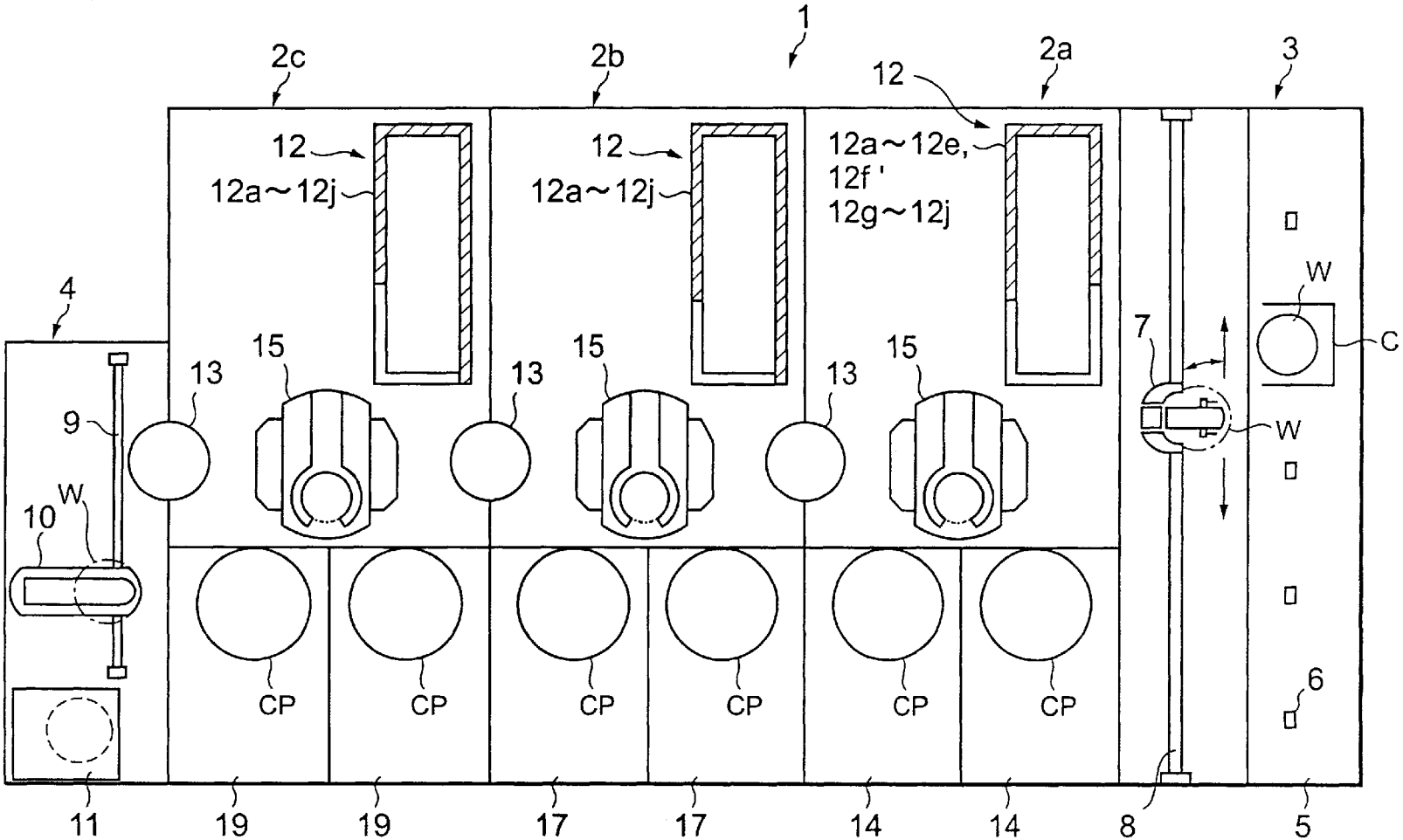
FIG. 1 is a plan view showing the structure of a coating and developing process system according to a first embodiment of the present invention.
Figure 2:
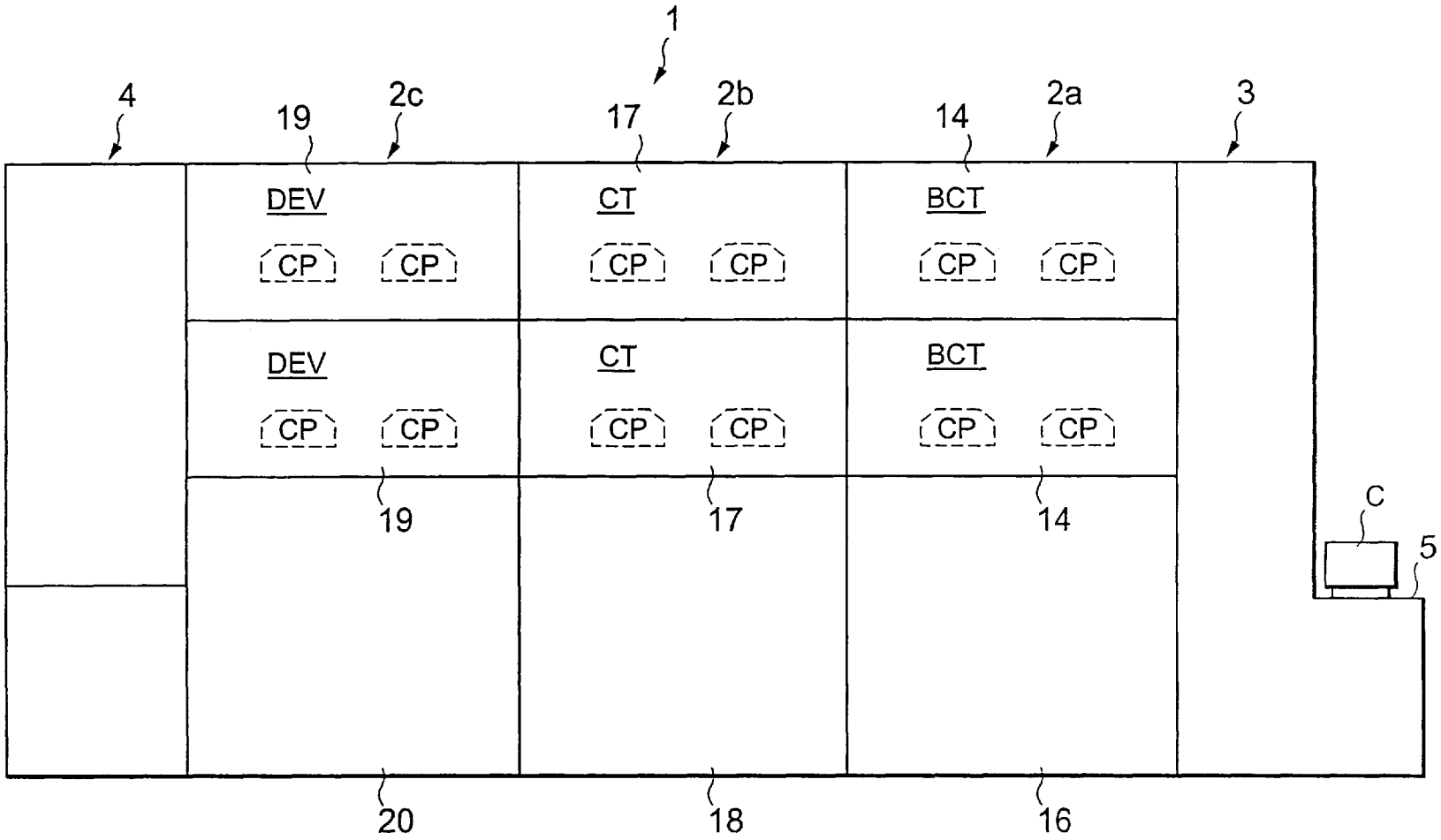
FIG. 2 is a front view showing the structure of the coating and developing process system shown in FIG. 1.
Figure 3:
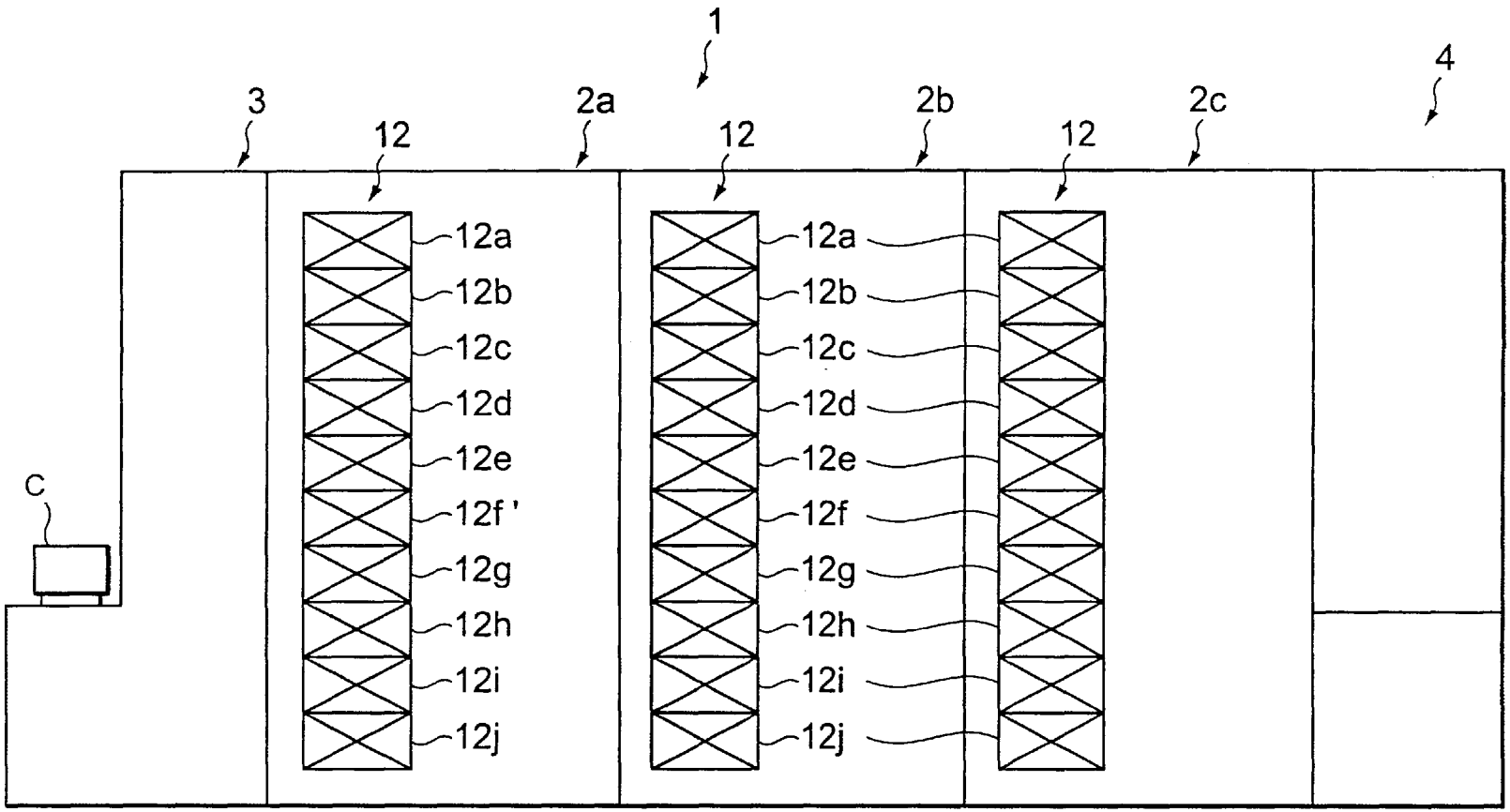
FIG. 3 is a rear view showing the structure of the coating and developing process system shown in FIG. 1.

FIG. 1 is a plan view showing the structure of a coating and developing process system according to a first embodiment of the present invention. FIG. 2 is a front view showing the structure of the coating and developing process system shown in FIG. 1. FIG. 3 is a rear view showing the structure of the coating and developing process system shown in FIG. 1.

In FIGS. 1, 2, and 3, a coating and developing process system 1 has a plurality of (for example three) process stations 2*a*, 2*b*, and 2*c* that are connected in parallel in such a manner that the second process station 2*b* is disposed between the first and third process stations 2*a* and 2*c*. A cassette station 3 is disposed outside the first process station 2*a*. The cassette station 3 loads and unloads a cassette C that accommodates for example 25 wafers W to/from the coating and developing process system 1. In addition, the cassette station 3 loads and unloads a wafer W to/from a cassette C. An interface portion 4 is disposed outside the third process station 2*c*. The interface portion 4 transfers a wafer W with an exposing unit (not shown).

The cassette station 3 has a cassette table 5. On the cassette table 5, a plurality of (for example five) cassettes C are disposed at positions of alignment protrusions 6 in such a manner that wafer entrances of cassettes C face the process station 2*a*. In other words, five cassettes C are arranged in the direction X. A conveying unit 7 is disposed between the first process station 2*a* and the cassette station 3. The conveying unit 7 is movable in the direction of which the cassettes C are arranged (X direction) and the direction of which wafers Ware accommodated in each cassette C (Z direction). In addition, the conveying unit 7 is movable along a conveying path 8. Thus, the conveying unit 7 can selectively access each wafer W accommodated in each cassette C. Moreover, the conveying unit 7 is rotatable in the direction. Thus, the conveying unit 7 can access a transferring table disposed in each process unit of a multi-staged process unit block of the process station 2*a*.

The interface portion 4 has a conveying unit 10 that is movable in the X direction along a conveying path 9 and in the Z direction and is rotatable in the direction. In addition, a periphery exposing unit 11 is disposed at one end of the conveying path 9. The conveying unit 10 can access a transferring table of the process station 2*c*, the exposing unit disposed adjacent to the process station 2*c*, and the periphery exposing unit 11.

A process unit block 12 is disposed at a rear portion on one side of the process station 2*a*. The process unit block 12 has multi-staged (for example, ten-staged) units that are heating and cooling process units (CHP) 12*a* to 12*e*, 12*g* to 12*j*, and a transferring unit 12*fa* as a first process unit block. A transferring table 13 is disposed at a center position on the other side of the process station 2*a*. The transferring table 13 transfers a wafer W with the adjacent process station 2*b*. A total of four process units (BCT) 14 are disposed as an upper left unit, an upper right unit, a lower left unit, and a lower right unit at an upper front portion of the process station 2*a*. Each of the process units (BCT) 14 coats a reflection resisting solution to a wafer W. A vertical type conveying unit 15 is disposed at a nearly center portion of the process station 2*a*. The conveying unit 15 is movable in the Z direction and is rotatable in the direction. Thus, the conveying unit 15 can access the heating and cooling process units (CPH) 12*a* to 12*j*, the transferring table 13, and the process units (BCT) 14. A solution supplying portion 16 is disposed at a front lower portion of the process station 2*a* (in other words, at a lower portion of the process units (BCT) 14). The solution supplying portion 16 supplies a coating solution to the process units (BCT) 14. The solution supplying portion 16 has a tank and a pump (not shown). The pump draws for example a process solution from the tank and supplies the process solution to the process units (BCT) 14.

The structure of each of the process stations 2*b* and 2*c* is the same as the structure of the process station 2*a*.

In other words, a process unit block 12 is disposed at a rear portion on one side of the process station 2*b*. A transferring table 13 is disposed at a center portion on the other side of the process station 2*b*. Four process units (CT) are disposed at a front upper portion of the process station 2*b*. Each of the process units (CT) 17 supply a resist solution to a wafer W. A conveying unit 15 is disposed at a nearly center portion of the process station 2*b*. A solution supplying portion 18 is disposed at a front lower portion of the process station 2*b*. The solution supplying portion 18 supplies a resist solution to the process units (CT) 17. The structure of the solution supplying portion 18 is the same as the structure of the solution supplying portion 16.

A process unit block 12 is disposed at a rear portion on one side of the process station 2*c*. A transferring table 13 is disposed at a center portion on the other side of the process station 2*c*. Four process units (DEV) 19 are disposed at a front upper portion of the process station 2*c*. Each of the process units (DEV) 19 performs a developing process for a wafer W. A conveying unit 15 is disposed at a nearly center portion of the process station 2*c*. A solution supplying portion 20 is disposed at a front lower portion of the process station 2*c*. The solution supplying portion 20 supplies a resist solution to the process units (DEV) 19. The structure of the solution supplying portion 20 is the same as the structure of each of the solution supplying portions 16 and 18.

Figure 4:
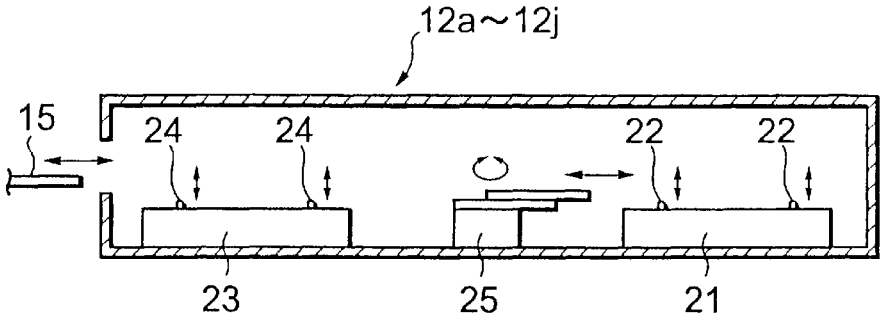
FIG. 4 is an outlined side view showing the structure of a heating and cooling process unit of the coating and developing process system according to the first embodiment of the present invention.

FIG. 4 is an outlined side view showing the structure of each of the heating and cooling process units (CHP) 12*a* to 12*j*.

As shown in FIG. 4, a heating process plate 21 is disposed on one side (at a rear portion of the system) of each of the heating and cooling process units (CHP). The heating process plate 21 heats a wafer W. For example three protrusible support pins 22 are disposed on the front surface of the heating process plate 21. The three protrusible support pins 22 support a wafer W. A raisable lid (not shown) may be disposed at an upper portion of the heating process plate 21.

A cooling process plate 23 is disposed on the other side (a front portion of the system) of each of the heating and cooling process units (CHP). The cooling process plate 23 cools a wafer W. As with the structure of the heating process plate 21, the cooling process plate 23 has three protrusible support pins 24 that support a wafer W.

A conveying unit 25 is disposed between the heating process plate 21 and the cooling process plate 23. The conveying unit 25 is movable in the Z direction and is rotatable in the direction. The conveying unit 25 can access the heating process plate 21 and the cooling process plate 23 so as to transfer a wafer W therebetween.

The conveying unit 15 transfers a wafer W to the cooling process plate 23 in the state that the protrusible support pins 24 protrude from the front surface of the cooling process plate 23. Thereafter, the conveying unit 25 receives the wafer W from the protrusible support pins 24 and transfers the wafer W to the heating process plate 21 in the state that the protrusible support pins 22 protrude from the front surface of the heating process plate 21. Thereafter the protrusible support pins 22 hide from the front surface of the heating process plate 21. Thus, the wafer W is heated by the heating process plate 21. Thereafter, the protrusible support pins 22 rise and protrude from the front surface of the heating process plate 21. In this state, the conveying unit 25 receives the wafer W from the protrusible support pins 22 and transfers the wafer W to the cooling process plate 23 in the state that the protrusible support pins 24 protrude from the front surface of the cooling process plate 23. Thereafter, the protrusible support pins 24 lower and hide from the front surface of the cooling process plate 23. The wafer W is placed on the cooling process plate 23. Thus, the wafer W is cooled by the cooling process plate 23. Thereafter, the protrusible support pins 24 rise and protrude from the front surface of the cooling process plate 23. In this state, the conveying unit 15 receives the wafer W from the protrusible support pins 24.

Figure 5:
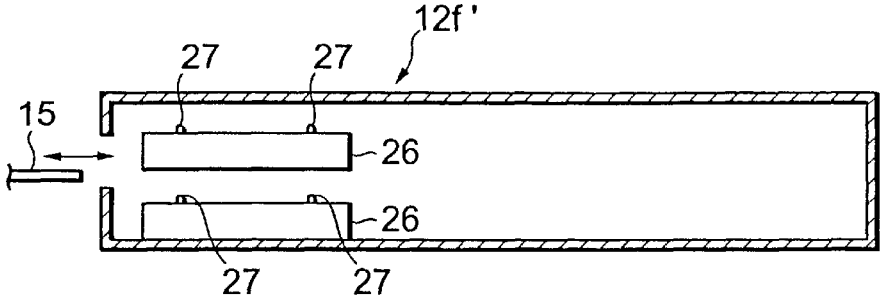
FIG. 5 is an outlined side view showing the structure of a transferring unit of the coating and developing process system according to the first embodiment of the present invention.

FIG. 5 is an outlined side view showing the structure of the transferring unit 12*f*'.

As shown in FIG. 5, two transferring tables 26 are disposed as an upper transferring table and a lower transferring table on one side of the transferring unit 12*f*' (at a front portion of the system). Each of the transferring tables 26 has for example three support pins that support a wafer w. In addition, each of the transferring tables 26 also has an alignment function for a wafer W.

The conveying unit 7 of the cassette station 3 accesses one of the transferring tables 26 and transfers a wafer W thereto. The conveying unit 15 of the process station 2*a* receives the wafer W from the transferring table 26. In such a manner, the wafer W is loaded to the process station 2*a*. On the other hand, the conveying unit 15 of the process station 2*a* accesses one of the transferring tables 26 and transfers a wafer W thereto. The conveying unit 7 of the cassette station 3 receives the wafer W from the transferring table 26. In such a manner, the wafer W is unloaded from the process station 2*a*.

Figure 6:
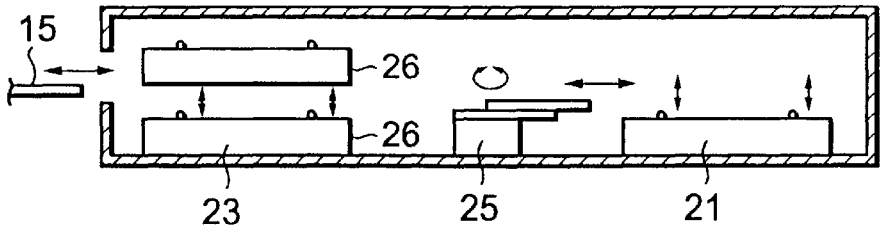
FIG. 6 is an outlined side view showing another structure of the transferring unit.

As shown in FIG. 6, when the transferring table 26 is disposed at an upper portion of the cooling process plate 23 of each of the heating and cooling process units (CHP), the dedicated transferring unit shown in FIG. 5 can be omitted.

Figure 7:
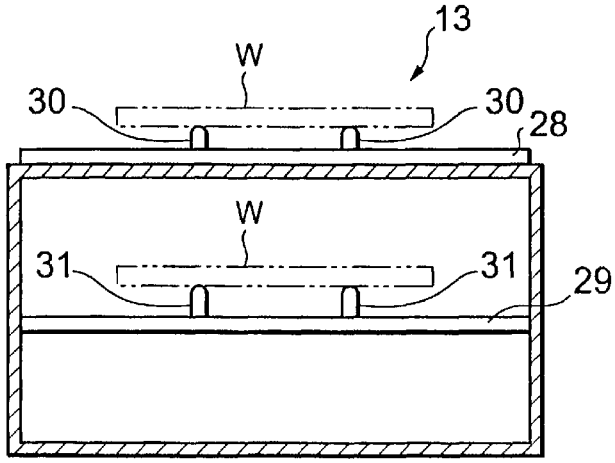
FIG. 7 is a side view showing an outlined structure of a transferring table of the coating and developing process system according to the first embodiment of the present invention.

FIG. 7 is a side view showing an outlined structure of the transferring table 13.

As shown in FIG. 7, the transferring table 13 has an upper table portion 28 and a lower table portion 29. The upper table portion 28 has for example three support pins that support the rear surface of a wafer W. The lower table portion 29 has for example three support pins 31 that support the rear surface of a wafer W. Thus, the transferring table 13 supports a total of two wafers (upper and lower wafers) with the support pins 30 and 31.

Figure 8:
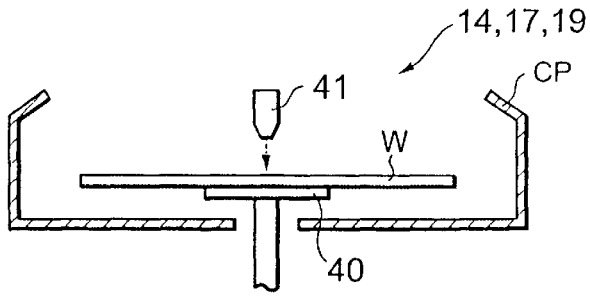
FIG. 8 is a side view showing an outlined structure of a process unit of the coating and developing process system according to the first embodiment of the present invention.

FIG. 8 is a sectional view showing an outlined structure of each of the process units (BCT) 14, the process units (CT) 17, and the process units (DEV) 19.

As shown in FIG. 8, a cup CP is disposed at a nearly center portion of each of these units. A spin chuck 40 is disposed in the cup CP. The spin chuck 40 rotatably holds a wafer W. A nozzle 41 that supplies a process solution to a wafer W is disposed at an upper portion of the spin chuck 40. The spin chuck 40 can be raised and lowered. The spin chuck 40 transfers a wafer W with the conveying unit 15 in the state that the spin chuck 40 is raised against the cup CP. The nozzle 41 supplie a process solution to the wafer W in the state that the wafer W is placed in the cup CP. When the process solution is supplied from the nozzle 41 to the wafer W, the spin chuck 40 is rotated.

Figure 9:
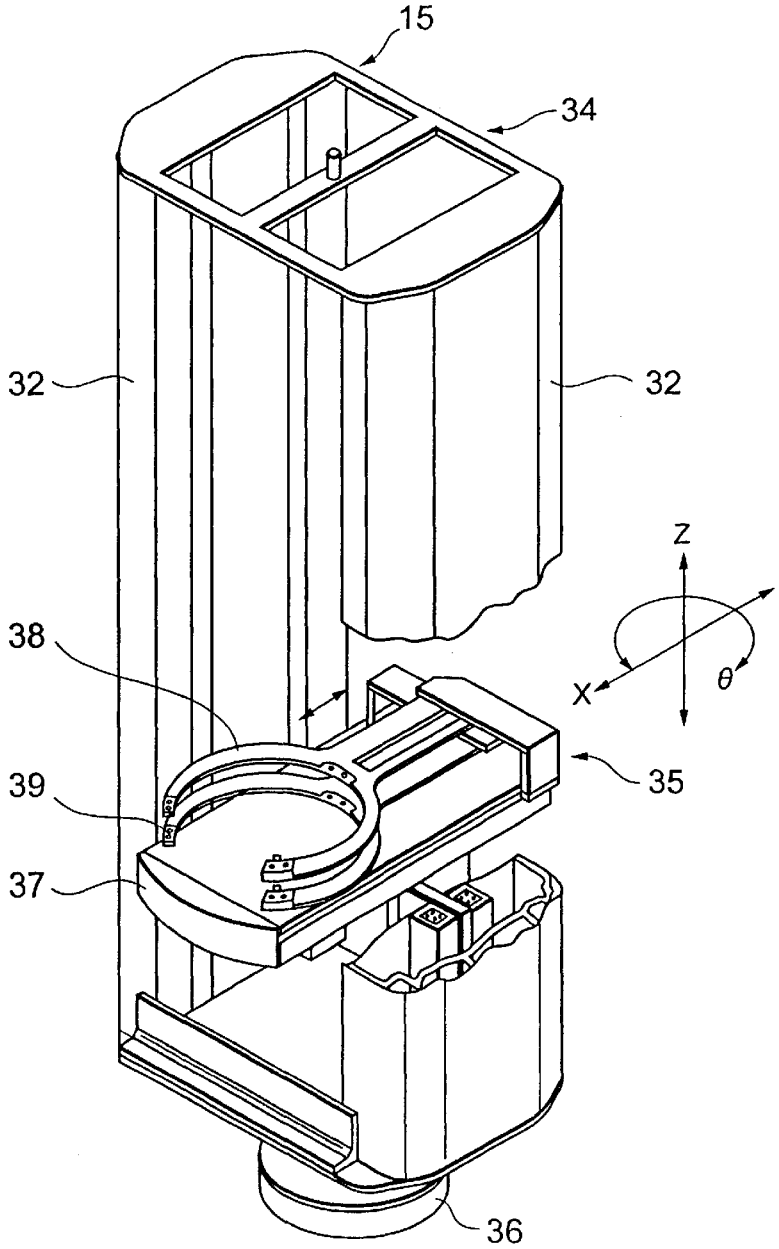
FIG. 9 is a perspective view showing an outlined structure of a conveying unit of the coating and developing process system according to the first embodiment of the present invention.

FIG. 9 is a perspective view showing an outlined structure of the conveying unit 15.

As shown in FIG. 9, the conveying unit 15 has a wafer conveying means 35 that is raised and lowered in the vertical (Z) direction. The wafer conveying means 35 is disposed in a cylindrical support member 34 composed of two side wall portions 32 that are connected at the upper and lower ends thereof. The cylindrical support member 34 is connected to a rotating shaft of a motor 36. With the rotating force of the motor 36, the cylindrical support member 34 is rotated along with the wafer conveying means 35 around the rotating shaft. Thus, the wafer conveying means 35 is rotatable in the direction.

Two pairs of tweezers 38 and 39 (upper and lower tweezers) are disposed on a conveying pedestal 37 of the wafer conveying means 35. The structure of the upper tweezers 38 is basically the same as the structure of the lower tweezers 39. The cylindrical support member 34 has a space and a size that allow the upper and lower tweezers 38 and 39 to pass. The upper and lower tweezers 38 and 39 are movable in the front and rear directions with a motor (not shown) disposed in the conveying pedestal 37.

Next, steps of the process of the coating and developing process system 1 will be described.

In the coating and developing process system, after a virgin wafer W accommodated in a cassette C is extracted by the conveying unit 7 of the cassette station 3, the wafer W is conveyed to the transferring unit 12*f*' of the process station 2*a* and aligned.

Thereafter, the wafer W is conveyed to the heating and cooling process units (CHP) 12*a* to 12*j* of the process station by the conveying unit 15 of the process station 2*a*. The wafer W is placed on the cooling process plate 23 of a predetermined unit of the heating and cooling process units (CHP) 12*a* to 12*j*. Thereafter, the wafer W is placed on the cooling process plate 23 of the predetermined unit of the heating and cooling process units (CHP) 12*a* to 12*j*. Thereafter, the wafer W is cooled by the cooling process plate 23.

Thereafter, the wafer W that has been cooled is conveyed to a predetermined unit of the process units (BCT) 14 by the conveying unit 15 of the process station 2*a*. In the process unit (BCT) 14, a process solution for a reflection resisting film is coated on the wafer W.

Thereafter, the wafer W coated with the reflection resisting film is conveyed to a predetermined unit of the heating and cooling process units (CHP) 12*a* to 12*j* of the process station 2*a* by the conveying unit 15 of the process station 2*a*. The wafer W is placed on the heating process plate 21 of the predetermined unit of the heating and cooling process units (CHP) 12*a* to 12*j*. The wafer W is heated by the heating process plate 21. The heating and cooling process units (CHP) 12*a* to 12*j* are categorized as low temperature type units and high temperature type units. After a wafer W is heated by a low temperature type unit, the wafer W is heated by a high temperature type unit.

Thereafter, the wafer W is conveyed to the transferring table 13 of the process station 2*a* by the conveying unit 15 of the process station 2*a*.

Thereafter, the wafer W is conveyed from the transferring table 13 of the process station 2*a* to a predetermined unit of the heating and cooling process units (CHP) 12*a* to 12*j* of the process station 2*b* by the conveying unit 15 of the process station 2*b*. The wafer W is placed on the cooling process plate 23 of the predetermined unit of the heating and cooling process units (CHP) 12*a* to 12*j*. The wafer W is cooled by the cooling process plate 23.

Thereafter, the wafer w that has been cooled is conveyed to a predetermined unit of the process units (CT) 17 by the conveying unit 15 of the process station 2*b*. In the predetermined unit of the process units (CT) 17, a resist solution is coated on the wafer W.

Thereafter, the wafer W coated with the resist solution is conveyed to a predetermined unit of the heating and cooling process units (CHP) 12*a* to 12*j* of the process station 2*b* by the conveying unit 15 of the process station 2*b*. The wafer W is placed on the heating process plate 21 of the predetermined unit of the heating and cooling process unit (CHP) 12*a* to 12*j*. The wafer W is heated by the heating process plate 21. Thereafter, the wafer W is placed on the cooling process plate 23. The wafer W is cooled by the cooling process plate 23.

Thereafter, the wafer W that has been cooled is conveyed to the transferring table 13 of the process station 2*b* by the conveying unit 15 of the process station 2*b*.

Thereafter, the wafer W is conveyed from the transferring table 13 of the process station 2*b* to the transferring table 13 of the process station 2*c* by the conveying unit 15 of the process station 2*c*.

Thereafter, the wafer W is conveyed from the transferring table 13 of the process station 2*c* to the periphery exposing unit 11 by the conveying unit 10 of the interface portion 4. The periphery of the wafer W is exposed by the periphery exposing unit 11.

Thereafter, the wafer W that has been periphery exposed is conveyed to the exposing unit (not shown) by the conveying unit 10 of the interface portion 4.

Thereafter, the wafer W that has been exposed by the exposing unit is conveyed to the transferring table 13 of the process station 2*c* by the conveying unit 10 of the interface portion 4.

Thereafter, the wafer W is conveyed from the transferring table 13 of the process station 2*c* to a predetermined unit of the heating and cooling process units (CHP) 12*a* to 12*j* of the process station 2*c* by the conveying unit 15 of the process station 2*c*. The wafer W is placed on the heating process plate 21 of the predetermined unit of the heating and cooling process units (CHP) 12*a* to 12*j*. The wafer W is heated by the heating process plate 21. Thereafter,the wafer W is placed on the cooling process plate 23. The wafer W is cooled by the cooling process plate 23.

Thereafter, the wafer W that has been cooled is conveyed to a predetermined unit of the process units (DEV) 19 of the process station 2*c* by the conveying unit 15 of the process station 2*c*. The wafer W is developed by the predetermined unit of the process units (DEV) 19.

Thereafter, the wafer W that has been developed is conveyed to a predetermined unit of the heating and cooling process units (CHP) 12*a* to 12*j* of the process station 2*c* by the conveying unit 15 of the process station 2*c*. The wafer W is placed on the heating process plate 21 of the predetermined unit of the heating and cooling process units (CHP) 12*a* to 12*j*. The wafer W is heated by the heating process plate 21.

Thereafter, the wafer W that has been heated is conveyed to the transferring table 13 of the process station 2*b* by the conveying unit 15 of the process station 2*c*.

Thereafter, the wafer W is conveyed from the transferring table 13 of the process station 2*b* to the transferring table 13 of the process station 2*a* by the conveying unit 15 of the process station 2*b*.

Thereafter, the wafer W is conveyed from the conveying table 13 of the process station 2*a* to the transferring unit 12*f'* of the process station 2*a* by the conveying unit 15 of the process station 2*a*.

Thereafter, the wafer that has been processed and conveyed to the transferring unit 12*f'* of the process station 2*a* is accommodated in a predetermined cassette C by the conveying unit 7 of the cassette station 3.

Figure 10:
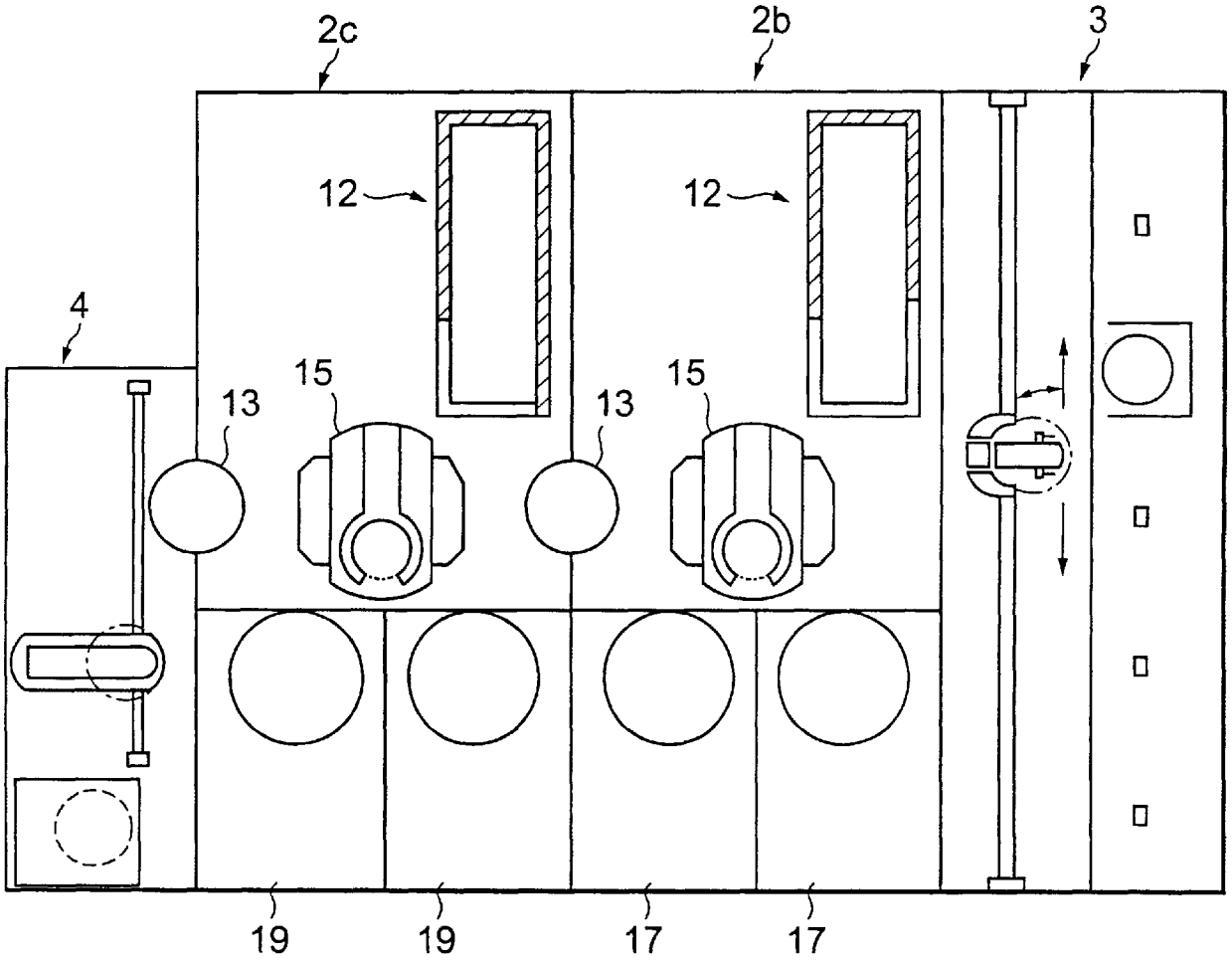
FIG. 10 is a first plan view for explaining the operation and effect of the coating and developing process system according to the first embodiment of the present invention.
Figure 11:
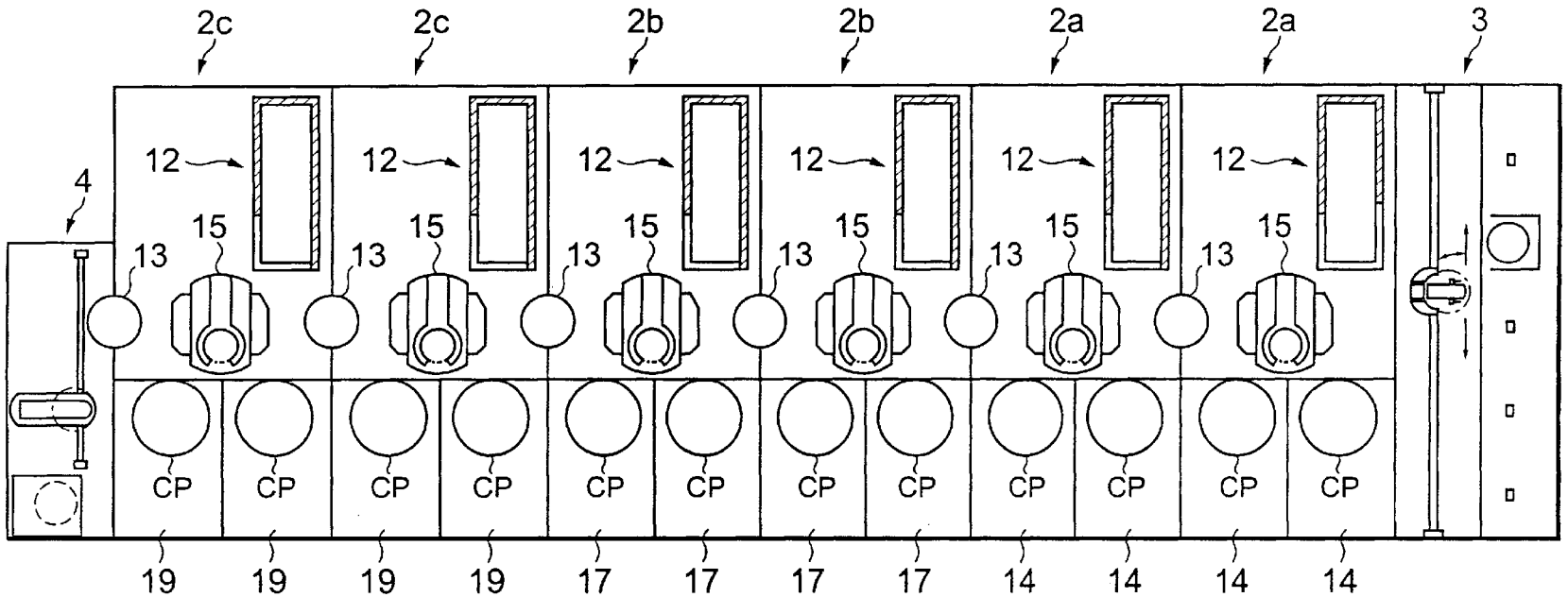
FIG. 11 is a second plan view for explaining the operation and effect of the coating and developing process system according to the first embodiment of the present invention.

In the coating and developing process system 1, since a plurality of process stations 2*a*, 2*b*, and 2*c* that have the same structure are connected, the system 1 can be dynamically and effectively expanded or reduced. For example, when the reflection resisting film coating process is not necessary, as shown in FIG. 10, only the process station 2*a* is removed from the coating and developing process system 1 shown in FIGS. 1 to 3. Only the process station 2*b* and the cassette station 3 are connected. When the process performance should be improved two times, as shown in FIG. 11, two process stations 2*a*, two process stations 2*b*, and two process stations 2*c* are used. For example, the cassette station 3, the process station 2*a*, the process station 2*a*, the process station 2*b*, the process station 2*b*, the process station 2*c*, the process station 2*c*, and the interface portion 4 are connected in succession.

In each process station of the coating and developing process system 1, the process units (BCT) 14, the process units (CT) 17, the process units (DEV) 19, the heating and cooling process unit (CHP) 12*a* to 12*j*, and the transferring tables 13 are disposed in such a manner that they surround the vertical type conveying units 15. In addition, the heating and cooling process units (CHP) 12*a* to 12*j* are disposed at a rear portion on the left side of each process station. The transferring table 13 is disposed at a center portion on the right side of each process station. Thus, a maintenance space is provided on the rear of the conveying table 13 of each process station. Consequently, a maintenance work for the conveying portion can be easily performed.

In the coating and developing process system according to the first embodiment, since the process units (BCT) 14, the process units (CT) 17, and the process units (DEV) 19 that use different types of process solutions are disposed in different process stations, their atmospheres can be easily controlled. In this case, since the same process units are adjacently disposed in each process station, a common nozzle can be used between adjacent process units. Thus, the number of expensive nozzles can be decreased.

In the coating and developing process system 1 according to the first embodiment, the cooling portion having the cooling process plate 23 that cools a wafer W is disposed adjacent to each of the process units 14, 17, and 19. Thus, the solution process units are prevented from being thermally affected by the heating and cooling process units (CHP) 12*a* to 12*j*. In addition, since the conveying distance from the cooling portion to each of the solution process units 14, 17, and 19 becomes short, solution processes can be performed in a thermally good condition (a wafer W is stably cooled at a predetermined temperature).

Next, a second embodiment of the present invention will be described.

Figure 12:
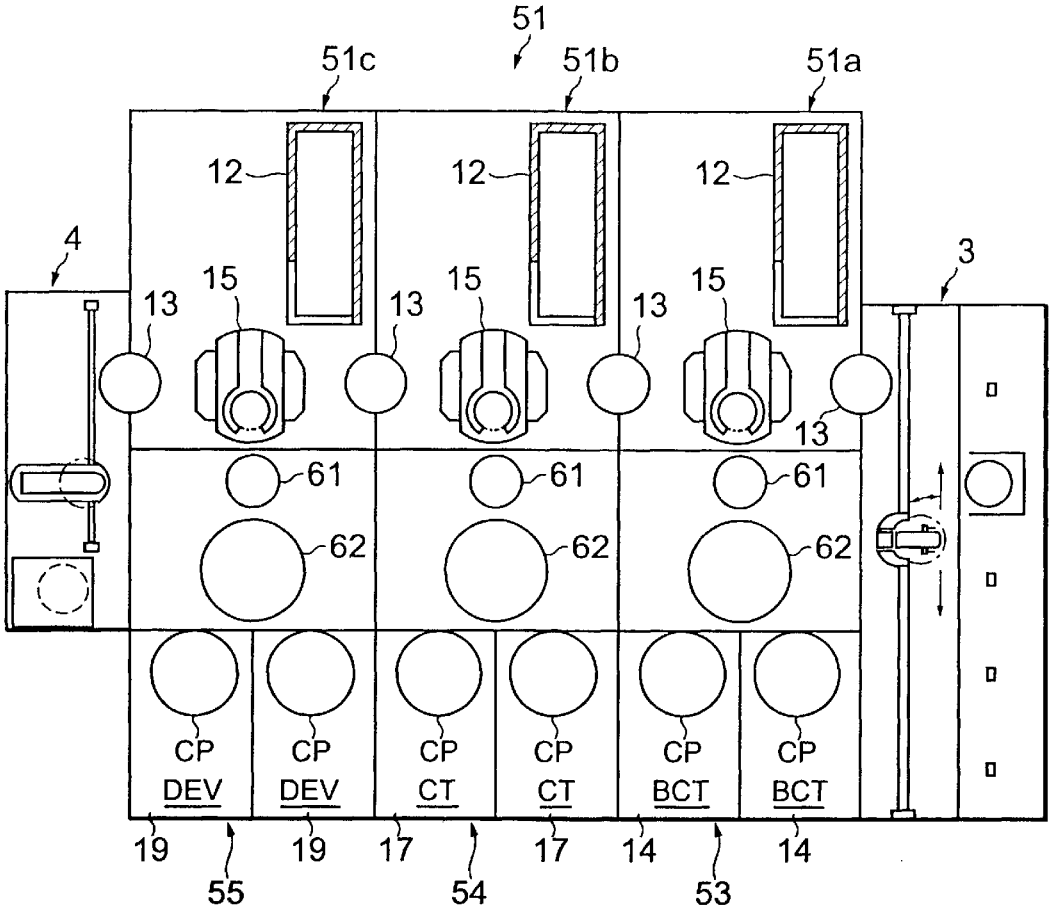
FIG. 12 is a plan view showing the structure of the coating and developing process system according to a second embodiment of the present invention.

FIG. 12 is a plan view showing the structure of a coating and developing process system according to the second embodiment of the present invention. For simplicity, in FIG. 12, similar portions to those in the first embodiment are denoted by similar reference numerals.

As shown in FIG. 12, a coating and developing process system 51 has process stations 51*a*, 51*b*, and 51*c* that are connected in parallel as a second process unit. The structure of each of the process stations 51*a*, 51*b*, and 51*c* is different from the structure of the process stations 2*a*, 2*b*, and 2*c* of the first embodiment. In addition, the structure of each of process units 53, 54, and 55 of the second embodiment is different from the structure of each of the process units 53, 54, and 55 of the first embodiment.

Figure 13:
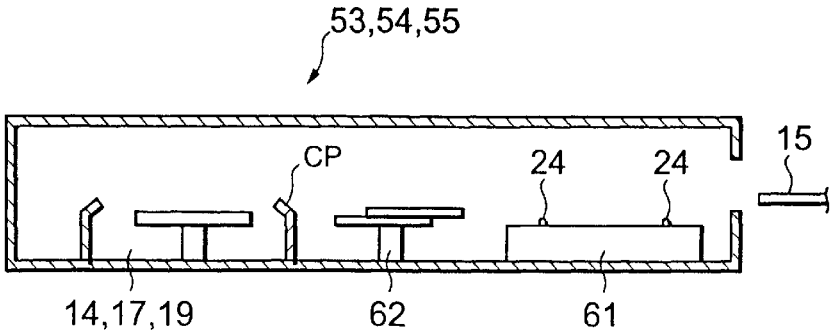
FIG. 13 is a side view showing an outlined structure of the process unit of the coating and developing process system according to the second embodiment of the present invention.

FIG. 13 is a side view showing an outlined structure of each of the process units 53, 54, and 55.

As shown in FIG. 13, a cooling process plate 61 is disposed on one side (adjacent to a conveying unit 15) of each of the process units 53, 54, and 55. The cooling process plate 61 cools a wafer W. For example three protrusible support pins 24 are disposed on the front surface of the cooling process plate 61. With the three protrusible support pins 24, a wafer W is supported.

Two process units (BCT) 14 are disposed in parallel on the other side of the process unit 53. Two process units (CT) 17 are disposed in parallel on the other side of the process unit 54. Two process units (DEV) 19 are disposed in parallel on the other side of the process unit 55.

A conveying unit 62 is disposed between the cooling process plate 61 and each of the process units (BCT) 14. The conveying unit 62 transfers a wafer W between the cooling process plate 61 and each of the process units (BCT) 14. The conveying unit 62 is movable in the z direction and is rotatable in the direction. The conveying unit 62 can access the cooling process plate 61 and each of the process units (BCT) 14. Likewise, a conveying unit 62 is disposed between the cooling process plate 61 and each of the process units (CT) 17. The conveying unit 62 transfers a wafer W between the cooling process plate 61 and each of the process units (CT) 17. The conveying unit 62 is movable in the z direction and is rotatable in the direction. The conveying unit 62 can access the cooling process plate 61 and each of the process units (CT) 17. Likewise, a conveying unit 62 is disposed between the cooling process plate 61 and each of the process units (DEV) 19. The conveying unit 62 transfers a wafer W between the cooling process plate 61 and each of the process units (DEV) 19. The conveying unit 62 is movable in the z direction and is rotatable in the direction. The conveying unit 62 can access the cooling process plate 61 and each of the process units (DEV) 19.

Thus, according to the second embodiment of the present invention, a wafer W is conveyed from the conveying unit 15, the cooling process plate 61, the conveying unit 62, and a predetermined unit of the process units (BCT) 14 (a predetermined unit of the process units (CT) 17, or a predetermined unit of the process units (DEV) 19). The processed wafer W is returned from the predetermined unit of the process units (BCT) 14 (the predetermined unit of the process units (CT) 17 or the predetermined unit of the process units (DEV) 19), the conveying unit 62, the cooling process plate 61, and the conveying unit 15.

According to the second embodiment of the present invention, in addition to the same operation and effect as the first embodiment, the environments of the cooling process plates 61 are the same in the process units (BCT) 14, the process units (CT) 17, and the process units (DEV) 19. Thus, the atmosphere and temperature can be easily controlled.

Next, a third embodiment of the present invention will be described.

Figure 14:
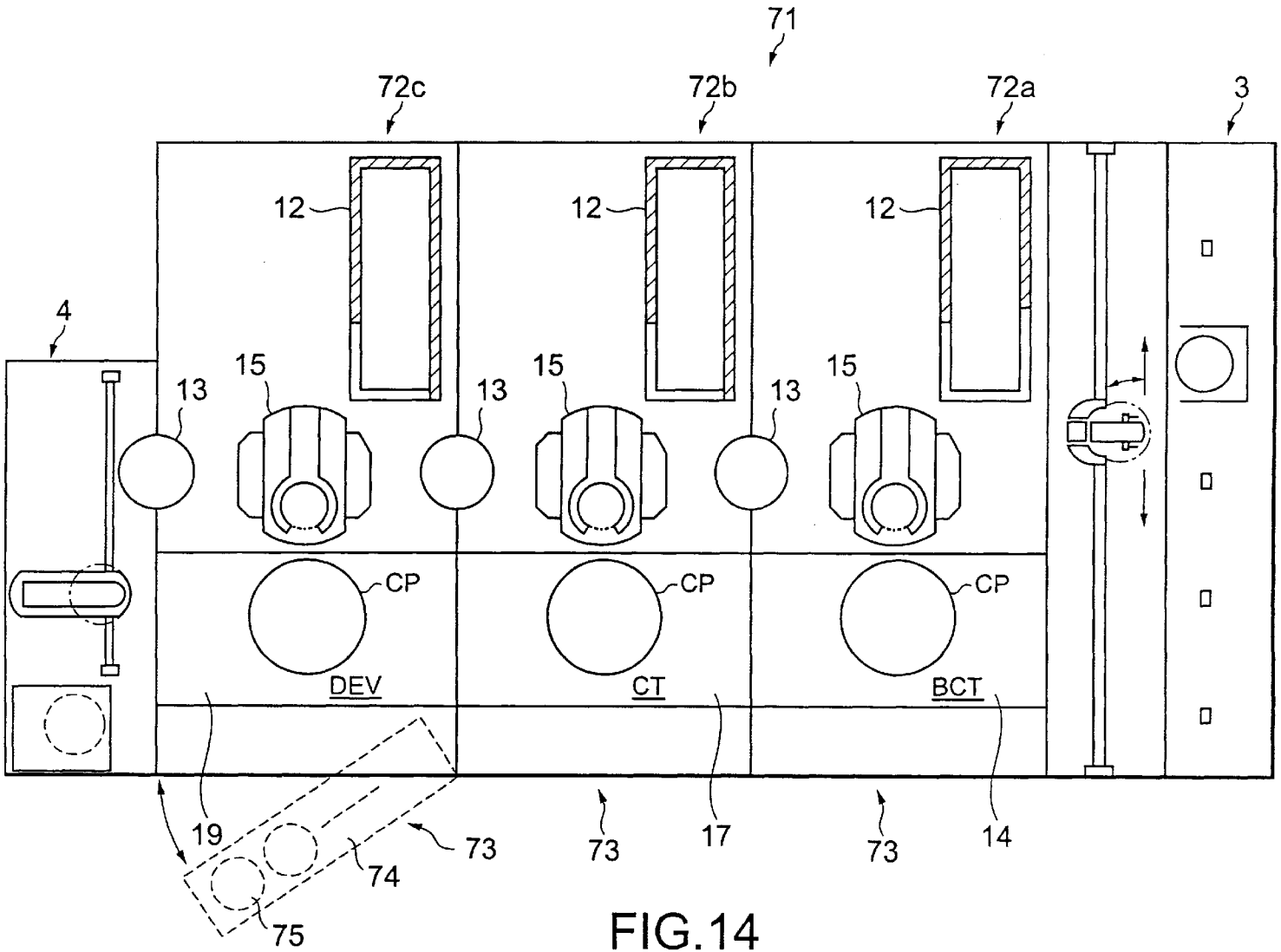
FIG. 14 is a plan view showing the structure of a coating and developing process system according to a third embodiment of the present invention.
Figure 15:
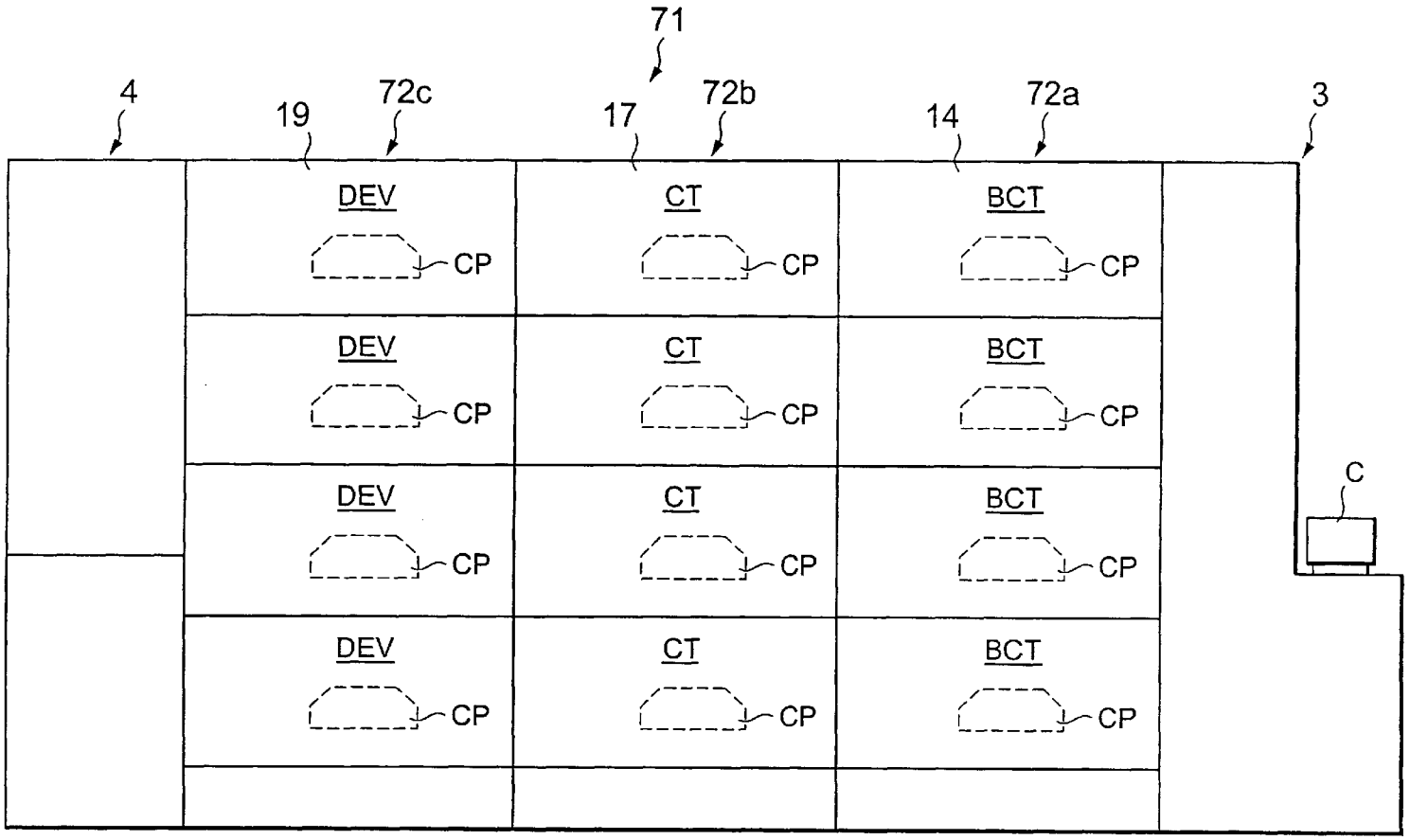
FIG. 15 is a front view showing the structure of the coating and developing process system shown in FIG. 14.

FIG. 14 is a plan view showing the structure of a coating and developing process system according to the third embodiment of the present invention. FIG. 15 is a front view of the coating and developing process system. In FIG. 14 and 15, similar portions to those in the first embodiment are denoted by similar reference numerals.

As shown in FIGS. 14 and 15, the structure of each of process stations 72*a*, 72*b*, and 72*c* of a coating and developing process system 71 is different from the structure of each of the process stations 2*a*, 2*b*, and 2*c* of the first embodiment. In the process station 72*a*, four-staged process units (BCT) 14 are disposed at a front portion of the process station 72*a*. In the process station 72*b*, four-staged process units (CT) 17 are disposed at a front portion of the process station 72*b*. In the process station 72*c*, four-staged process units (DEV) 19 are disposed at a front portion of the process station 72*c*. A solution supplying portion 73 is disposed outside the process units (BCT) 14. The solution supplying portion 73 supplies a process solution to the process units (BCT) 14. Likewise, a solution supplying portion 73 is disposed outside the process units (CT) 17. The solution supplying portion 73 supplies a process solution to the process units (CT) 17. Likewise, a solution supplying portion 73 is disposed outside the process units (DEV) 19. The solution supplying portion 73 supplies a process solution to the process units (DEV) 19.

Each of the solution supplying portions 73 has a door 74 that is accessible from the outside. A tank 75 is disposed inside the door 74. The tank 75 stores a process solution. Each of the solution supplying portions 73 has a pump (not shown) that draws the process solution from the tank 75 and supplies the process solution to each process unit.

According to the third embodiment of the present invention, in addition to the same operation and effect as the first embodiment, since the solution supplying portions 73 are disposed outside the process units, the volumes of the solution supplying portions 73 can be increased. For example, the amount of the solution stored in each solution supplying portion 73 can be increased.

Next, a fourth embodiment of the present invention will be described.

Figure 16:
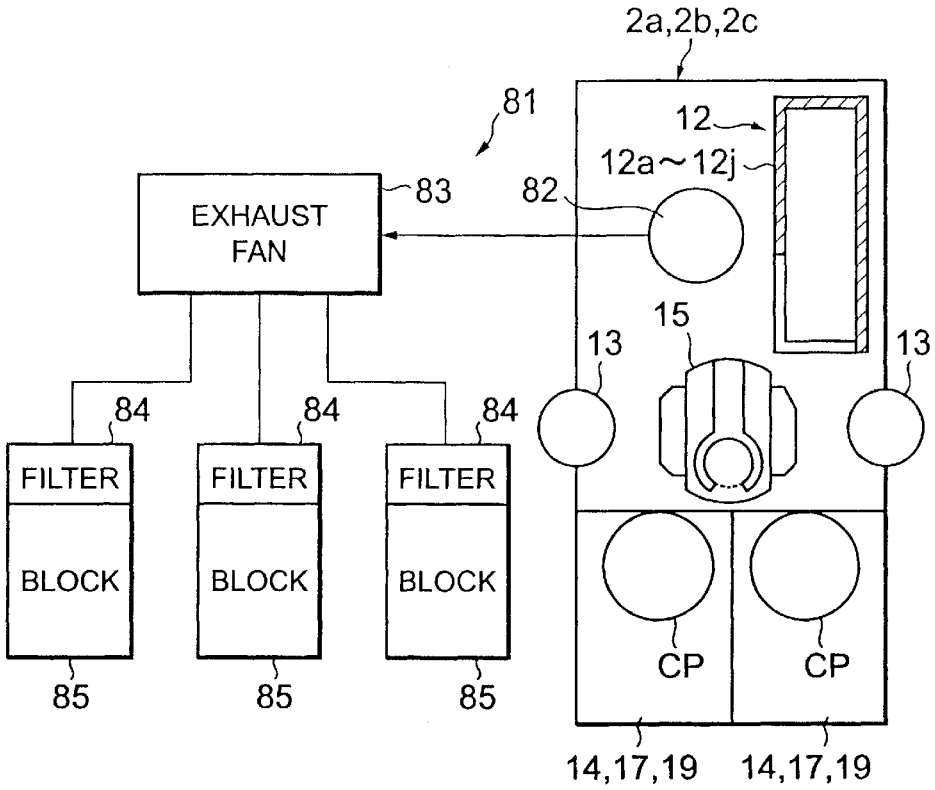
FIG. 16 is a partial plan view showing the structure of the coating and developing process system according to a fourth embodiment of the present invention.

As shown in FIG. 16, in a system according to the fourth embodiment, a gas exhausting portion 81 is disposed in each of process stations 2*a*, 2*b*, and 2*c*. The gas exhausting portions 81 centrally exhaust gas from the process stations 2*a*, 2*b*, and 2*c*. Each of the gas exhausting portions 81 has a gas exhausting opening 82 at a lower portion in such a manner that a conveying unit 15 is disposed between the gas exhausting opening 82 and the second process unit block (BCT, CT, or DEV) 14, 17, or 19. A gas exhausting fan 83 is connected to the gas exhausting opening 82. Gas exhausted by the gas exhausting fan 83 is filtered by a filter portion 84. Thus, clean air is supplied from the top of the block 85. For example, the block 85 is composed of a process station 2*a*, a conveying unit 15, and a process unit 14.

Since gas is centrally exhausted through the gas exhausting opening 82 disposed at a lower portion opposite to the second process unit block (BCT, CT, or DEV) 14, 17, or 19 in such a manner that the conveying unit 15 is disposed between the gas exhausting opening 82 and the second process unit block (BCT, CT, or DEV) 14, 17, or 19, exhausted gas of each block does not mix. In particular, exhausted gas of a solution process unit and exhausted gas of a heat process unit do not mix. Thus, thermal interference and atomospheric interference can be prevented in each unit. In other words, the atmosphere of a chemical of one unit is prevented from flowing to another unit.

Next, a fifth embodiment of the present invention will be described.

Figure 17:
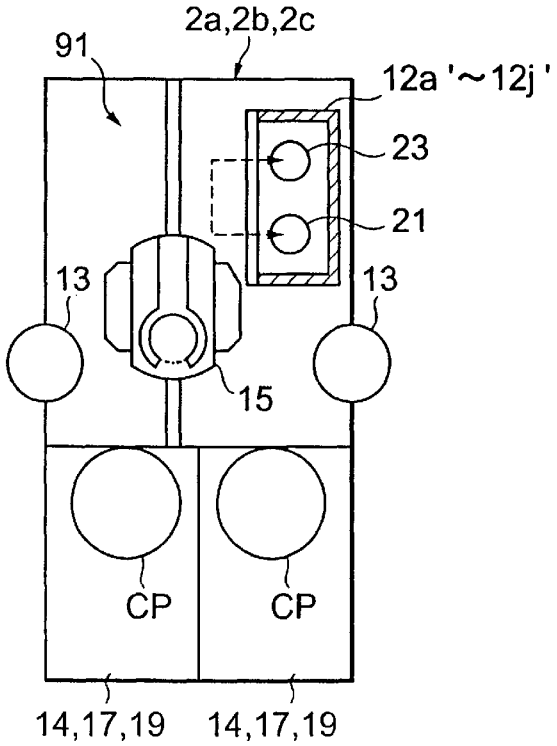
FIG. 17 is a partial plan view showing the structure of a coating and developing process system according to a fifth embodiment of the present invention.

As shown in FIG. 17, in a system according to the fifth embodiment, each of heating and cooling process units (CHP) 12*a*' to 12*j*' of each of process stations 2*a*, 2*b*, and 2*c* has a heating process plate 21 and a cooling process plate 23. The heating process plate 21 is disposed at a rear portion of the system. The heating process plate 21 heats a wafer W. The cooling process plate 23 is disposed at a front portion of the system. The cooling process plate 23 cools a wafer W. However, unlike with the above-described embodiments, each process station does not have a conveying unit, but a conveying portion 15. A traveling mechanism 91 that moves the conveying portion 15 along one side of each of the heating and cooling process units (CHP) 12*a*' to 12*j*'. The conveying portion 15 can access both the heating process plate 21 and the cooling process plate 23 of each of the heating and cooling process units (CHP) 12*a*' to 12*j*'. Thus, according to the fifth embodiment of the present invention, the size of the heating and cooling process units (CHP) 12*a*' to 12*j*' can be reduced. Consequently, the size of the system can be reduced. In each of the heating and cooling process units (CHP) 12*a*' to 12*j*', the heating process plate 21 and the cooling process plate 23 can be disposed at the reverse positions. In other words, the cooling process plates 23 can be disposed adjacent to the second process unit block 14, 17, or 19. Thus, the second process unit blocks 14, 17, and 19 can be suppressed from the thermal influence of the heating process plates 21.

In the above-described embodiments, as substrates, wafers were exemplified. However, it should be noted that the present invention can be applied to other substrates such as LCD substrates.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A process system, comprising:

a plurality of process stations whose side surfaces are successively connected; and whose substrate loading/unloading portions, disposed adjacent to the outer side surfaces of two process stations at both ends of said plurality of process stations, for loading and unloading a substrate to/from each of said plurality of process stations wherein each of said plurality of process stations has:

a first process unit block, disposed on one side of each of said plurality of process stations, having multi-staged first process units including a process unit for performing at least a heating process for a substrate, a substrate transferring table, disposed on the other side of each of said plurality of process stations, for transferring a substrate with at least adjacent one of said plurality of process stations, a second process unit, disposed on the front or the rear of each of said plurality of process stations, for supplying at least a predetermined solution to a substrate, and a conveying unit, disposed at a nearly center portion of each of said plurality of process stations, for conveying a substrate among the first process unit block, the second process unit, the substrate transferring table of each of said plurality of process stations, and the substrate transferring table of an adjacent process station neighboring to each of said plurality of process stations.

2. The process system as set forth in claim 1, wherein the first process unit group adjacent to said substrate loading/unloading portion has:

a substrate transferring table for transferring a substrate with said substrate loading/unloading portion.

3. The process system as set forth in claim 1, wherein the process unit for performing at least a heating process for a substrate has:

a cooling process portion, disposed opposite to the conveying unit, for performing a cooling process for a substrate;

a heating process portion for performing a heating process for a substrate; and an inner-unit conveying unit for conveying a substrate between the cooling process portion and the heating process portion.

4. The process system as set forth in claim 3, wherein the cooling process portion is disposed opposite to said second process unit, and wherein the cooling process portion and the inner-unit conveying unit are disposed between the heating process portion and the second process unit.

5. The process system as set forth in claim 1, wherein the process unit for performing at least a heating process for a substrate has:

a cooling process portion, disposed opposite to the second process unit, for performing a cooling process for a substrate;

a heating process portion, disposed opposite to said cooling process portion with the second process portion, for performing a heating process for a substrate, and wherein the conveying unit has:

means for moving the conveying unit so as to access the second process unit, the cooling process portion, and the heating process portion.

6. The process system as set forth in claim 1, further comprising:

a gas exhausting portion for exhausting gas from the inside of each of said plurality of process stations through a gas exhausting opening disposed at a lower portion opposite to the second process unit with the conveying unit of each of said plurality of process stations.

7. The process system as set forth in claim 1, wherein the second process unit is composed of a plurality of units disposed in parallel to the conveying unit.

8. The process system as set forth in claim 7, wherein each of said plurality of process units has a plurality of second process units for performing the same process.

9. The process system as set forth in claim 1, wherein the second process unit block is disposed at an upper portion on the front or the rear of each of said plurality of process stations.

10. A process system, comprising:

a plurality of process stations whose side surfaces are successively connected; and two substrate loading/unloading portions, disposed adjacent to the outer side surfaces of two process stations at both ends of said plurality of process stations, for loading and unloading a substrate to/from each of said plurality of process stations, wherein each of said plurality of process stations has:

a first process unit block, disposed on one side of each of said plurality of process stations, having multi-staged first process units including a process unit for performing at least a heating process for a substrate, a substrate transferring table, disposed on the other side of each of said plurality of process stations, for transferring a substrate with at least adjacent one of said plurality of process stations, a second process unit, disposed on the front or the rear of each of said plurality of process stations, the second process unit having a cooling process portion for performing a cooling process for a substrate, a process unit for supplying at least a predetermined solution to a substrate, and an inner-unit conveying unit for conveying a substrate between the process unit and the cooling process portion, and a conveying unit, disposed at a nearly center portion of each of said plurality of process stations, for conveying a substrate among the first process unit block, the cooling process portion of the second process unit, the substrate transferring table of each of said plurality of process stations, and the substrate transferring table of an adjacent process station neighboring to each of said plurality of process stations.

11. The process system as set forth in claim 10, wherein said second process unit has a plurality of process units for supplying at least a predetermined solution to a substrate, the process units being disposed in parallel with the inner-unit conveying unit.

12. The process system as set forth in claim 11, wherein the second process unit has process units for performing the same process.

13. The process system as set forth in claim 10, wherein the first process unit group is disposed adjacent to said substrate loading/unloading portion and has a substrate transferring table for transferring a substrate with said substrate loading/unloading portion.

14. The process system as set forth in claim 10, wherein the process unit for performing at least a heating process for a substrate has:

a cooling process portion, disposed opposite to the conveying unit, for performing a cooling process for a substrate;

a heating process portion for performing a heating process for a substrate; and an inner-unit conveying unit for conveying a substrate between the cooling process portion and the heating process portion.

15. The process system as set forth in claim 10, wherein the second process unit is disposed at an upper portion on the front or the rear of each of said plurality of process stations, and wherein a solution supplying portion is disposed at a lower portion of each of the process units, the solution supplying portion supplying the predetermined solution to at least the process units.

16. A process system, comprising:

a plurality of process stations whose side surfaces are successively connected; and two substrate loading/unloading portions, disposed adjacent to the outer side surfaces of two process stations at both ends of said plurality of process stations, for loading and unloading a substrate to/from each of said plurality of process stations, wherein each of said plurality of process stations has:

a first process unit block, disposed on one side of each of said plurality of process stations, having multi-staged first process units including a process unit for performing at least a heating process for substrate, a substrate transferring table, disposed on the other side of each of said plurality of process stations, for transferring a substrate with at least adjacent one of said plurality of process stations, a second process unit block, disposed on the front or the rear of each of said plurality of process stations, the second process unit block having multi-staged second process units including a process unit for supplying at least a predetermined solution to a wafer, a solution supplying portion, disposed outside the second process unit block, for supplying the predetermined solution to process units of the second process unit group, and a conveying unit, disposed at a nearly center portion of each of said plurality of process stations, for conveying a wafer among the first process unit block, the second process unit block, the substrate transferring table of each of said plurality of process stations, and the substrate transferring table of an adjacent process station neighboring to said each of said plurality of process stations.

17. The process system as set forth in claim 16, wherein the first process unit group adjacent to said substrate loading/unloading portion has:

a substrate transferring table for transferring a substrate with said substrate loading/unloading portion.

18. The process system as set forth in claim 16, wherein the process unit for performing at least a heating process for a substrate has:

a cooling process portion, disposed opposite to the conveying unit, for performing a cooling process for a substrate;

a heating process portion for performing a heating process for a substrate; and an inner-unit conveying unit for conveying a substrate between the cooling process portion and the heating process portion.

19. The process system as set forth in claim 16, wherein the second process unit block is composed of a plurality of units multi-staged and disposed in parallel to the conveying unit.

20. The process system as set forth in claim 19, wherein each of said plurality of process units has a plurality of second process units for performing the same process.

21. The process system as set forth in claim 16, wherein said solution supplying portion has a door accessible from the outside of each of said plurality of process stations, and wherein a vessel is disposed inside the door, the vessel storing at least the predetermined solution.

* * * * *